US005139399A

United States Patent [19]

Hood

[11] Patent Number: 5,139,399

[45] Date of Patent: Aug. 18, 1992

[54] COMPRESSOR INTERSTAGE COOLANT INJECTOR NOZZLE

[75] Inventor: James A. Hood, Concord, N.C.

[73] Assignee: Ingersoll-Rand Company, Woodcliff Lake, N.J.

[21] Appl. No.: 779,555

[22] Filed: Oct. 18, 1991

[51] Int. Cl.[5] ..... F04C 23/00; F04C 29/04

[52] U.S. Cl. ..... 418/9; 418/100; 418/201.1

[58] Field of Search ..... 418/9, 100, 201.1; 417/243

[56] References Cited

U.S. PATENT DOCUMENTS 3,467,300 9/1969 Schibbye .
3,899,271 8/1975 Granuall ..... 418/100
3,910,731 10/1975 Persson et al. .
4,123,203 10/1978 Kathmann et al. .
4,174,196 11/1979 Mori et al. .

FOREIGN PATENT DOCUMENTS 3541838 6/1987 Fed. Rep. of Germany .
45-40396 12/1970 Japan ..... 418/100
60-17281 1/1985 Japan .
60-56104 4/1985 Japan ..... 418/100
2094891 9/1982 United Kingdom .

*Primary Examiner*—Richard A. Bertsch
*Assistant Examiner*—David L. Cavanaugh
*Attorney, Agent, or Firm*—Glenn B. Foster

[57] ABSTRACT

A liquid nozzle in use with an interstage passage of a two stage compressor and includes a first elongated element having a first elongated surface and a second elongated element having a second elongated surface. The first and second elongated surfaces are configured for mating engagement. A channel is formed in at least one of said first or second elongated surfaces with a coolant liquid in communication therewith. A first slot is formed in said first elongated surface. The first slot and the second elongated surface define a liquid orifice communicating the channel with said interstage passage. The nozzle preferably extends across an entire width of the interstage passage.

10 Claims, 4 Drawing Sheets

COMPRESSOR INTERSTAGE COOLANT INJECTOR NOZZLE

BACKGROUND OF THE INVENTION

This invention relates generally to a compressor interstage coolant nozzle and more particularly to a nozzle formed by the mating of two elements along a mating surface with a slot formed in at least one of the elements extending from a channel formed within the mating surface. The channel is capable of carrying cooling liquid. Cooling liquid escaping the nozzle is in communication with the interstage passage.

The fluid compression process generates considerable heat, in those instances where there are a plurality of stages of compressors arranged in series, it may be desired to provide a method of cooling the compressed fluid between the stages. Present methods of interstage cooling involves indirectly cooled or directly cooled methods.

In the indirectly cooled method, the fluid being compressed is routed through an air cooled or water cooled heat exchanger. This method results in a pressure drop in the compressed fluid and is also quite expensive.

In the directly cooled method, a coolant is directly injected into the interstage air stream. This method is less expensive than the above air cooled method and does not result in the pressure drop described. In order for this method to be effective, the heat transfer between the compressed air and the injected coolant liquid (traditionally oil in the case of oil flooded compressors) must be maximized.

One way to increase the heat transfer in the directly cooled method is to maximize the coolant surface area (decrease the droplet size). Previously, this minimizing of droplet size was accomplished by injecting the coolant through small holes or apertures. The present invention relates to optimizing the ease of manufacture of nozzle orifices of relatively small effective diameters and configurations without having to resort to prohibitively expensive manufacturing techniques.

The prior art coolant has been applied via holes drilled in the compressor housing. This drilling is time consuming and it is often difficult to drill holes of the small diameter and optimum shape which may be useful in producing a spray required for optimum cooling. It also may be difficult to ensure that the holes drilled meet the channel formed in the housing which supply liquid.

The foregoing illustrates limitations known to exist in present interstage coolant devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a liquid nozzle in use with an interstage passage of a two stage compressor including a first elongated element having a first elongated surface and a second elongated element having a second elongated surface. The first and second elongated surfaces are configured for mating engagement. A channel, which is in fluid communication with a coolant liquid, is formed in at least one of the first or second elongated surfaces. A first slot is formed in the first elongated surface. The first slot and the second elongated surface define a liquid orifice communicating the channel with the interstage passage.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
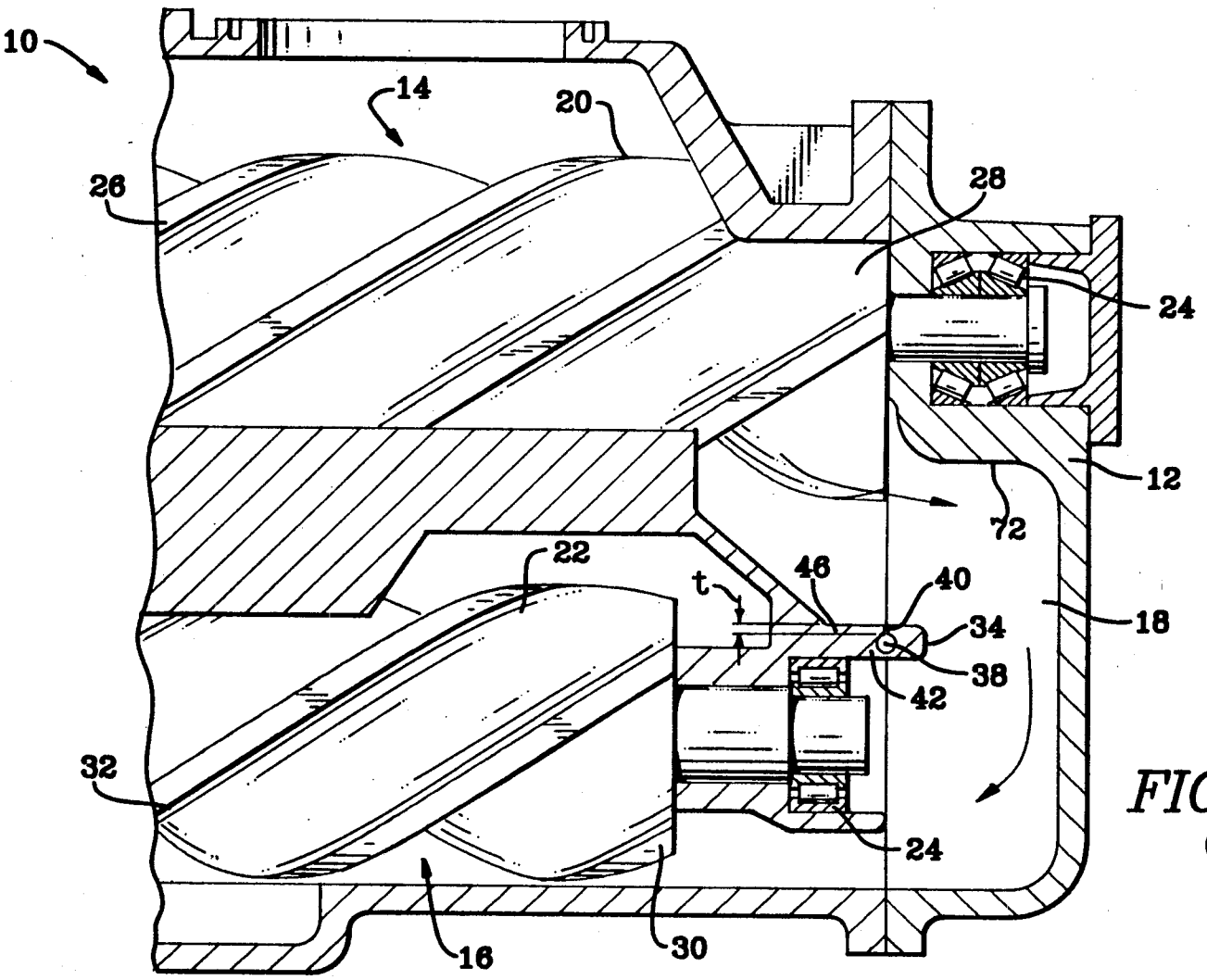
FIG. 1 (PRIOR ART)
FIG. 1 is a side cross sectional view illustrating an embodiment of a compressor including an interstage coolant injector nozzle of the prior art.

In this disclosure, elements which perform similar functions are provided with identical reference characters.

A compressor is illustrated generally as 10. The compressor includes a compressor housing 12 which houses a plurality of compressor stages 14, 16. When the compressor 10 is in operation, fluid passes through compressor stage 14 via an interstage passage 18 to compressor stage 16. Compressor stage 14 includes compressor rotors **20, 20*a* which are envisioned to be of the twin screw variety. Compressor stage 16 includes compressor rotors 22, 22*a* (not shown) which are also of the twin screw variety. It is envisioned that compressor stage 16 will operate at higher inlet and outlet pressures than compressor stage 14. Bearings 24 rotatably support both ends of the compressor rotors 20, 22, 20*a*, 22*a***.

The first compressor stage 14 has a first end 26 and a second end 28. The second compressor stage 16 also has a first end 30 and a second end 32. The first ends 26, 30 are envisioned to be the intake ends while the second ends 28, 32 of the compressor stages 14, 16 are typically the discharge ends. Using this convention, the interstage passage 18 typically communicates fluid between the second end 28 of the first compressor stage 14 and the first end 30 of the second compressor stage 16. The interstage passage 18 is machined in the compressor housing 12.

It is well known in the art that the compression process involves a generation of considerable heat to the compressor stages 14, 16, and to the working fluid being compressed. When compressor stages are connected in series, the latter stages experience considerable greater temperatures than desired for efficient compressor operation. This can result in damage to the compressor stages 14, 16 or the compressor itself. This increased temperature also hinders the general compression process, leading to inefficient operation of the compressor.

Therefore, an interstage coolant injection nozzle is often used to apply coolant liquid to the interstage passage 18 to effect coolant of the fluid passing through the interstage passage. FIG. 1 illustrates a prior art interstage coolant injector nozzle 34 while FIG. 2 displays an interstage coolant injector nozzle of the present invention 36.

The FIG. 1 prior art interstage injection coolant injector nozzle 34 includes channel 38 formed within a portion of the compressor housing 12 which supplies a coolant liquid to apertures 40. Apertures 40 are formed by drilling which requires the apertures have a minimal diameter of approximately 1/32nd of an inch. This diameter may under certain circumstances be insufficient to sufficiently disperse the liquid coolant into a sufficiently fine spray to produce an optimal cooling. The channel 38 and the apertures 40 are formed in a nozzle mount 42 which is formed as a single element.

Figure 2:
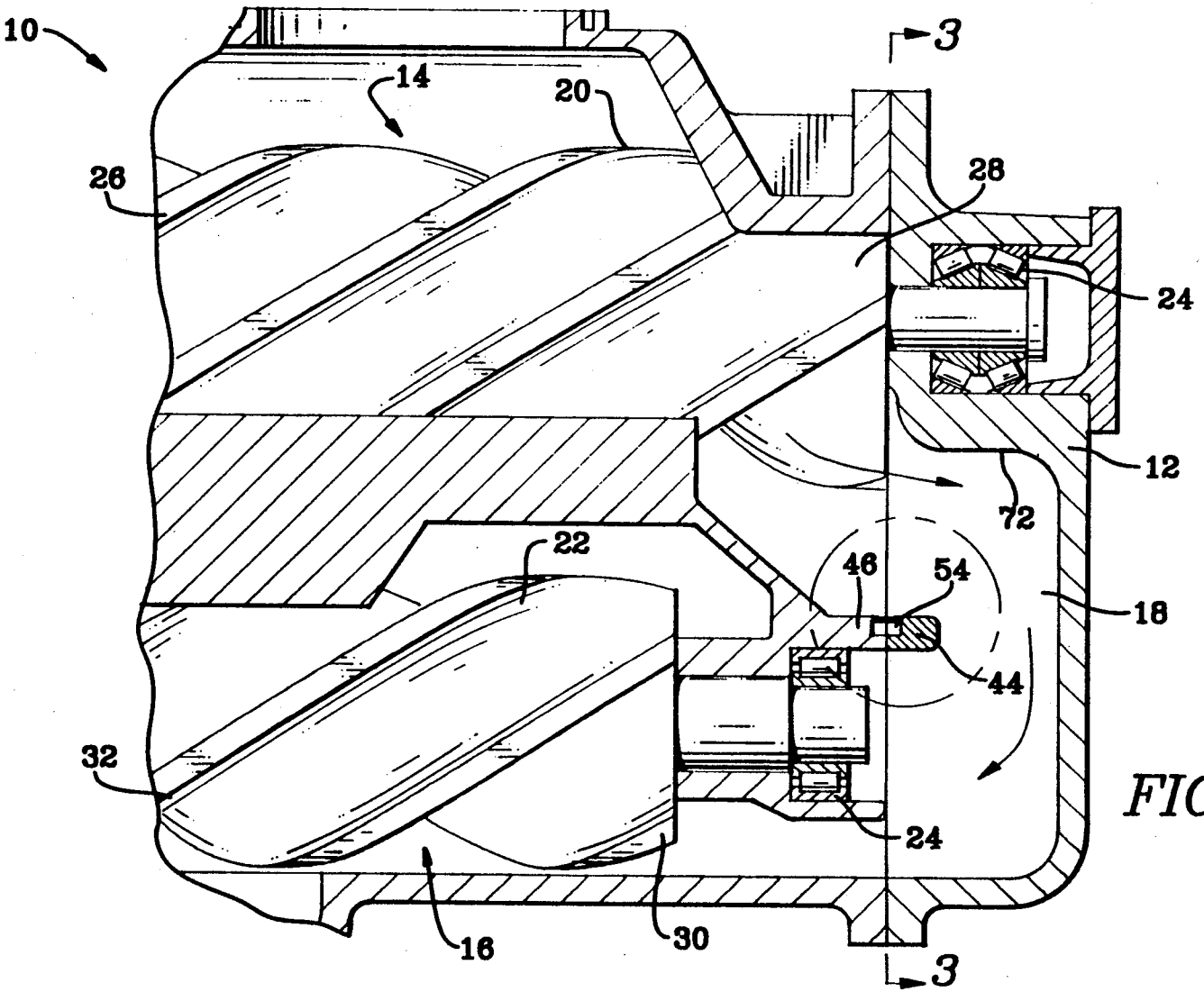
FIG. 2 is a side cross sectional view illustrating an embodiment of a compressor including an interstage coolant injector nozzle of the present invention.
Figure 4:
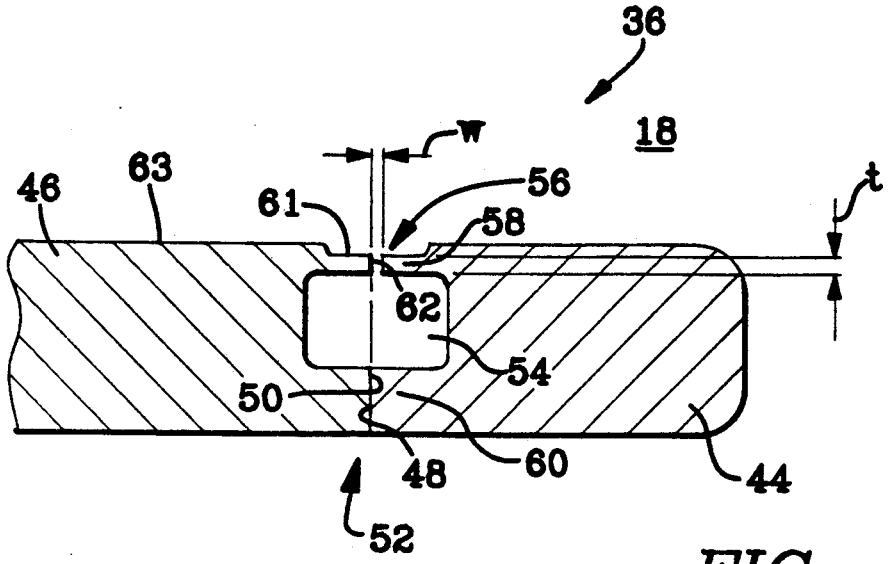
FIG. 4 is an enlarged view of the interstage coolant injector nozzle (encircled) portion of FIG. 2.

By comparison, the FIG. 2 interstage coolant injector nozzle 36 of the present invention includes a first elongated portion 44 and a second elongated portion 46. The first elongated portion 44 and the second elongated portion 46 have a first mating surface 48 and a second mating surface 50 (see FIG. 4), respectively, which when disposed in mating engagement and fastened by methods well known in the art, form a mating junction 52. A channel 54 is formed in either of or both of the first and second mating surfaces 48, 50 whereby cooling liquid can be supplied to the interstage coolant injector nozzle 36.

A liquid orifice 56 of the interstage coolant injector nozzle 36 is formed by the first elongated portion 44 having a lateral side 58 which is shorter than a second lateral side 60 located on an opposed side of said channel 54. This difference in lengths determines a width of the slot W in FIG. 4, which permits cooling liquid to pass from the channel 54 to the interstage passage 18. This slot 62 may be formed by milling or grinding, or it is envisioned that a moulded plastic may be used.

Since milling processes can remove considerably less material than the 1/32nd of an inch previously described by drilling processes. The slots 62 of the present invention (being of a smaller dimension) permits dispersal of liquid coolant into smaller droplet size than the prior art FIG. 1 drilled apertures 40. This will result in more efficient heat transfer of the coolant injected into the interstage passage than in the prior art.

Optimum performance relates not only to the diameter of the hole but also to the depth of the hole. In FIG. 1 for example, the depth t of the hole is difficult to alter. By comparison, simple milling processes permit a precise control of the thickness t in the FIG. 2 present invention embodiment.

The orifice 56 may be formed with a desired thickness t by machining away a groove 61 in a face 63. The thinner the desired thickness t, the greater the required thickness of material removed from the face 63 to form the groove 61.

Figure 3:
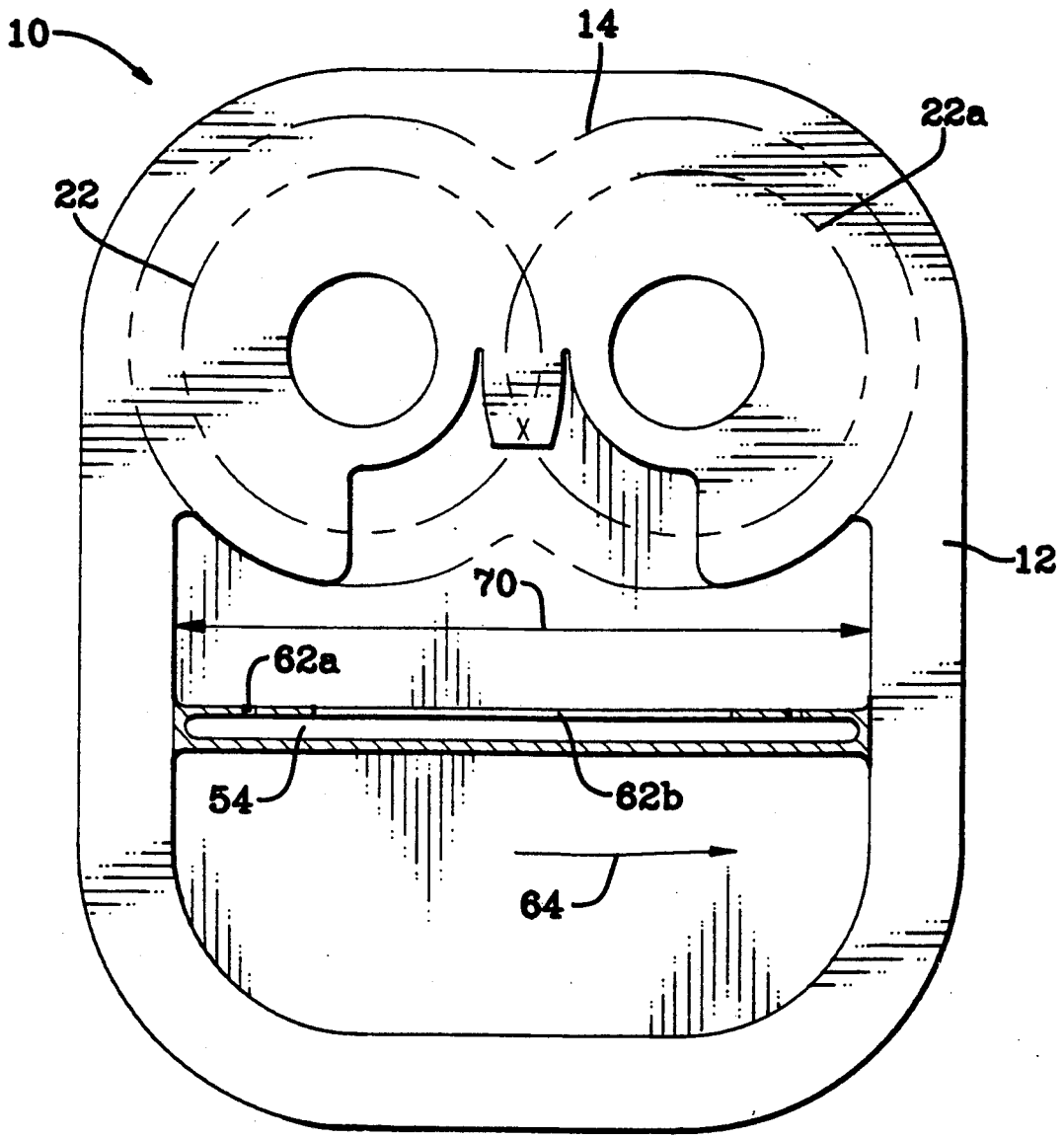
FIG. 3 is a cross sectional view taken along section lines 3—3 of FIG. 2.

It is also envisioned that the slots 62, 62*a*, 62*b* of the present invention, as illustrated in FIG. 3, may be formed of varying widths from a virtual pinpoint slot 62*a* to a slot which extends most of the width (or all of the width) of the interstage passage 62*b* along a transverse direction 64. The slots 62 may be formed within either the first elongated portion 44 or the second elongated portion 46, or both. In this disclosure, whichever elongated portion has a slot 62 formed in it (providing a slot is formed in only one elongated portion) is considered the first elongated portion 44.

Figure 5:
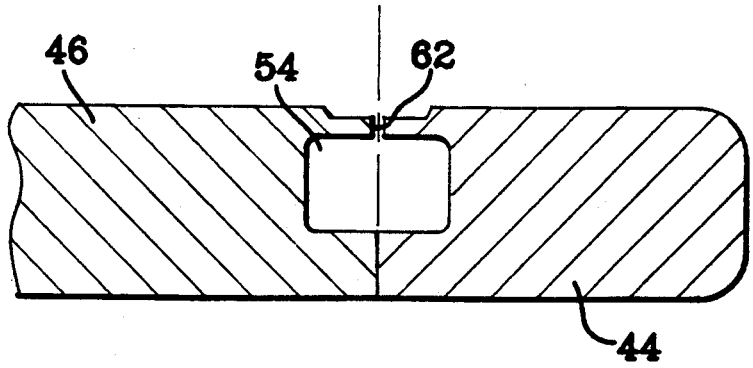
FIG. 5 is a view similar to FIG. 4, except with the slot being formed in both elongated surfaces.

It is also envisioned that the slot 62 may be formed in both elongated portions as illustrated in FIG. 5. In this embodiment, half of the material forming the slot 62 may be removed from the first elongated portion 44 and half from the other elongated portion 46. Alternately, a different percentage may be removed from either surface.

The slot 62 in either the first and/or the second elongated portions may be formed having a constant depth, resulting in a nozzle orifice with a rectangular cross section, or may be formed with a varying depth, resulting in a nozzle orifice with a rounded cross section. Clearly the cross section of the slot may be altered to produce differing cross sections of nozzle orifices as desired at reasonable cost.

While FIGS. 1 and 2 illustrate a U-shaped interstage passage 18 resulting from a parallel first compressor stage 14 and second compressor stage 16, it is envisioned that the interstage coolant injector nozzle 36 of the present invention may be applied to multiple axially disposed stage compressors or other configurations which are well known in the art and are not displayed here. The interstage coolant injection nozzle may be utilized with compressors not of the twin screw variety illustrated here, but with some compressor varieties well known in the art. The present invention may be applied to any multiple stage compressor where heat generation is a consideration.

The U-shaped interstage passage 18 illustrated in FIGS. 2 and 3 has a substantially rectangular opening. The slot(s) 62, 62*a*, 62*b* are configured to extend substantially across an entire width 70 of the interstage passage, and displace liquid to an opposed surface 72. Ideally, the sprayed coolant provides an effective coolant for the entire area to cover the fluid passing between the first compressor stage 14 and the second compressor stage 16.

While this invention has been illustrated and described in accordance with a preferred embodiment, it is recognized that other variations and changes may be made therein without departing from the invention as set forth in the claims.

Having described the invention, what is claimed is:

1. A liquid nozzle in use with an interstage passage of a two stage compressor comprising:
   - a first elongated element having a first elongated surface;
   - a second elongated element having a second elongated surface, the first and second elongated surfaces configured for mating engagement;
   - a channel formed in at least one of said first or second elongated surfaces, a coolant liquid being in communication with said channel; and
   - a first slot formed in said first elongated surface, said first slot and the second elongated surface defining a liquid orifice communicating the channel with said interstage passage.

2. The liquid nozzle as described in claim 1, wherein a second slot is formed in the second elongated surface which, during mating engagement, defines the liquid orifice in combination with said first slot.

3. The liquid nozzle as described in claim 1, wherein the first slot is dimensioned to be capable of producing a liquid jet extending across a substantial width of said interstage passage.

4. A compressor apparatus comprising:
   - a housing;
   - a first compressor stage and a second compressor stage arranged in series within said housing, each compressor stage having a first end and a second end, the first end of the second compressor stage being in close proximity to the second end of the first compressor stage, a pressure differential being created during operation of the compressor apparatus between the first end and the second end of each of the first and second compressor stages;

an interstage passage formed within said housing, communicating the second end of the first compressor stage with the first end of the second compressor stage;

an interstage coolant injection nozzle disposed along a length of said interstage passage having first and second elongated portions having first and second elongated surfaces, respectively, a mating surface being defined by the junction of the first and the second elongated surfaces, a channel being defined within the mating surface; and a slot formed in said first elongated surface, said slot and the second elongated surface defining a liquid orifice communicating the channel with the interstage passage.

5. The apparatus as described in claim 4, wherein the first compressor stage and the second compressor stage are mounted in parallel with the first end of the second compressor stage being adjacent said second end of the first compressor stage.

6. The apparatus as described in claim 4, wherein the interstage coolant injection nozzle is directed along a first axis which is substantially perpendicular to a second axis defining the general instantaneous direction of fluid flow within said interstage passage.

7. The apparatus as described in claim 4, wherein said slot is elongated in an axial direction of said first elongated portion.

8. The apparatus as described in claim 4, wherein the slot is abbreviated in an axial direction of said first elongated portion.

9. The apparatus as described in claim 4, wherein the second elongated portion has a groove formed therein which forms the liquid orifice in combination with said slot.

10. A compressor apparatus comprising:

a housing;

a first compressor stage and a second compressor stage located within said housing and arranged in series, each compressor stage having a first end and a second end, the first end of the second compressor stage being adjacent the second end of the first compressor stage and the second end of the second compressor stage being adjacent the first end of the first compressor stage, a pressure differential is capable of being created between the first end and the second end of each of the first and second compressor stages;

a U-shaped interstage passage formed within said housing having a series of cross sections, the interstage passage communicating the second end of the first compressor stage with the first end of the second compressor stage;

an interstage coolant injection nozzle disposed along a length of said opening having a first elongated portion with a first elongated surface and a second elongated portion having a first elongated surface, a mating surface being defined by the junction of the first and the second elongated surfaces, a channel being formed within the mating surface; and a slot formed in said first elongated surface, said slot and the second elongated surface defining a liquid orifice communicating the channel with the interstage passage, the orifice capable of expelling cooling liquid along a first direction which is substantially perpendicular to the cross section of the interstage passage, the expelled cooling liquid extends across substantially an entire width of said interstage passage.

* * * * *